United States Patent [19]

Fleishman et al.

[11] 4,421,180

[45] Dec. 20, 1983

[54] PILE DRIVER

[75] Inventors: Leonard Fleishman, Woodsburgh; Henry J. Lynch, Cedarhurst, both of N.Y.

[73] Assignee: Orin H. Jinnings, Fort Wayne, Ind. ; a part interest

[21] Appl. No.: 238,002

[22] Filed: Feb. 25, 1981

[51] Int. Cl.[3] ..... B25D 11/10

[52] U.S. Cl. ..... 173/124; 173/123; 173/139; 173/131; 173/132

[58] Field of Search ..... 173/31, 37, 53, 122, 173/123, 124, 125, 126, 139, 162 R, 131, 132; 279/4; 74/49, 50

[56] References Cited

U.S. PATENT DOCUMENTS

| | | | |
|---|---|---|---|
| 2,342,601 | 2/1944 | Pyle | 173/123 X |
| 3,009,522 | 11/1961 | Bedner | 173/31 X |
| 3,244,241 | 4/1966 | Ferwerda | 173/139 X |
| 3,356,164 | 12/1967 | Mount | 173/102 |
| 3,396,980 | 8/1968 | Muller | 279/4 |
| 3,448,817 | 6/1969 | Morishiba et al. | 173/123 X |
| 3,612,188 | 10/1971 | Ono | 173/139 X |
| 3,714,787 | 2/1973 | Clements et al. | 405/245 |
| 3,785,444 | 1/1974 | Gray | 173/78 |
| 3,817,091 | 6/1974 | Frederick | 173/139 X |
| 3,937,286 | 2/1976 | Wagner | 173/124 X |

*Primary Examiner*—Frederick R. Schmidt

*Assistant Examiner*—Robert P. Olszewski

*Attorney, Agent, or Firm*—Albert L. Jeffers; Robert G. Irish; John F. Hoffman

[57] ABSTRACT

A pile driving device of the drop hammer variety is disclosed and includes a crane supportable housing containing a hydraulic drive motor and a cam member for executing generally circular motion within the housing in response to operation of the drive motor and a ram depending from the housing of a substantial mass and having a bearing plate selectively engageable by the cam with cam motion sequentially raising the ram and disengaging the bearing plate to allow the ram to free fall and impact a pile. Also depending from the housing is a vertical guide arrangement for limiting ram motion to generally vertical reciprocating motion limited at one end by the pile being driven and at the upper extreme by the uppermost position of the cam member. The drop hammer assembly may further include a sleeve which is removably attachable to a pile upper end and which extends upwardly therefrom to provide a sleeve portion in which the ram may reciprocate. The sleeve may include an escape path for air, moisture and the like which may be within the tube and displaced therefrom by the free falling ram and may include between the ram and the pile a slightly cushioned but substantially quieting impact transmitting cushion.

11 Claims, 10 Drawing Figures

PILE DRIVER

BACKGROUND OF THE INVENTION

The present invention relates generally to pile drivers and more particularly to a pile driver of the drop hammer variety. More specifically, the present invention relates to such a drop hammer assembly which is crane supportable and nearly self-contained.

Pile drivers or pile hammers now in general use are frequently powered by means of compressed air, steam or diesel fuel within a self-contained cylinder. The hammers powered by steam or compressed air cylinders require auxiliary power sources such as air compressors and steam boilers which are costly additions to the pile driving rig and require considerable maintenance, fuel and in some cases, additional personnel.

Drop hammers are in less general use and derive their impact energy solely by hoisting a weight and then permitting it to fall freely under the influence of gravity to impact the pile being driven. Drop hammers are quite noisy and this noise problem has caused their use to be prohibited in some areas. The other hammer types discussed above also create considerable noise and in the case of air operated hammers, compressor noise, unless suppressed or muffled at great expense, exceeds permissible noise levels. Both the air and steam powered hammers cause pollutents from their respective power sources to be added to the atmosphere. Also, in cold weather operations, compressors are frequently difficult to start and boiler water supplies may freeze. Except for drop hammers, the manufacture of these powered hammers is costly, breakdowns are frequent due to the complexity of the designs and the repairs are time consuming and costly with spare parts often not readily available.

There has also been some investigation into the design and operation of hydraulically powered pile hammers utilizing hydraulic pistons or cylinders in lieu of the air, steam or diesel cylinder configurations discussed earlier. It has been found that due to the extremely high pressures needed in these hammers, their manufacture is extremely expensive and more complex than their predecessors. In some cases, the high pressures generated by the hydraulic system constitute a safety hazard and the failure of the hammer cylinder to resist such pressures could result in rapid disintegration of the hammer with explosive force. Rupturing of the hydraulic lines or their overheating is also an inherent problem with such hydraulically powered hammers.

It would be highly desirable to retain the advantages of hydraulic systems while obviating the above-mentioned as well as other disadvantages.

SUMMARY OF THE INVENTION

Among the several objects of the present invention may be noted the provision of a drop hammer characterized by modest power requirements, quiet operation, the ready availability of replacement parts, as well as ease of repair and overall minimum complexity; the provision of a nearly self-contained crane supportable hydraulically actuable drop hammer which derives its hydraulic power from a crane prime mover driven hydraulic source; the provision of a drop hammer employing a single rotating cam which selectively engages a bearing plate to raise the drop hammer ram and disengage the bearing plate, allowing the ram to fall and impact a pile; and the provision of a slightly cushioning but substantially quieting junction between a pile driver and a pile being driven. These as well as other objects and advantageous features of the present invention will be in part apparent and in part pointed out hereinafter.

In general, a crane supportable hydraulically actuable drop hammer assembly according to the present invention for use in a pile driving process has a housing which supports a hydraulic drive motor with an axially extending drive shaft and a roller cam driven by the drive shaft to execute generally circular motion along with a ram of substantial mass having a bearing plate selectively engageable with the roller cam for raising the ram and a guide arrangement for limiting motion of the ram to a generally vertical direction. Movement of the roller cam in a selected direction about its circular path results in the roller cam engaging the underside of the bearing plate and raising the ram until the bearing plate and roller cam disengage, allowing the ram to fall and impact a pile, with ram motion being thereby limited at one extreme in the vertical direction by the pile being driven, and at the other extreme by the uppermost position of the roller cam. An impact cushioning arrangement in the form of a sleeve removably attachable to a pile upper end and extending upwardly therefrom to provide a region within which the ram may reciprocate and a cushion member near the bottom of the sleeve in good force transmitting relationship with the pile upper end may be provided for noise reducing purposes.

BRIEF DESCRIPTION OF THE DRAWING

Corresponding reference characters indicate corresponding parts throughout the several views of the drawing.

Figures 1, 2, 3, 4, 8, 9:
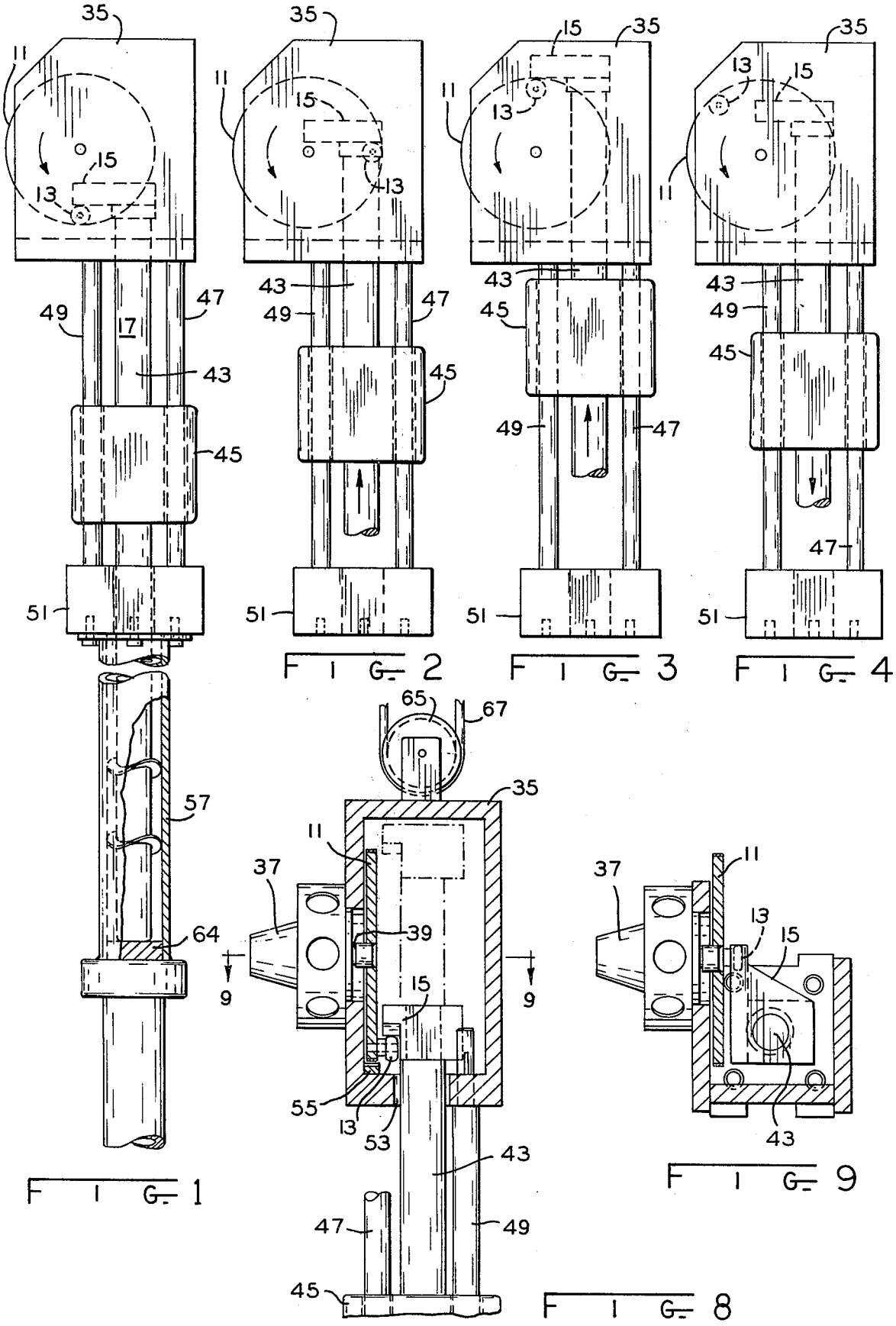
FIG. 1 is a side elevation view partly in cross-section of a drop hammer assembly according to the present invention and with the ram shown in its lowermost position.
FIG. 2 is a side elevation view of a portion of the drop hammer assembly of FIG. 1 but illustrating the ram in a partially raised position.
FIG. 3 is a view similar to FIG. 2 but illustrating the ram in its fully raised position.
FIG. 4 is a view similar to FIGS. 2 and 3 but illustrating the ram and roller cam disengaged with the ram free falling toward a pile.
FIG. 8 is a detailed sectional view of the drop hammer assembly housing of FIGS. 1 through 4 and 6.
FIG. 9 is a view of the housing along section line 9—9 of FIG. 8.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring to the drawing generally, the pile driver of the present invention employs a hydraulic motor having modest energy requirements to rotate disc 11 which has an eccentrically mounted roller cam 13 thereon. This roller cam engages the underside of a bearing plate 15, raising ram 17 until the eccentric roller cam 13 moves counterclockwise as viewed, so as to clear the bearing plate 15, allowing the bearing plate and ram to drop against the pile 23 being driven. A cushion 19 is located near the bottom of a guide sleeve 21 with the sleeve being clamped to the pile 23 by a hydraulic clamping arrangement 25. Thus, ram 17 drops in sleeve 21 to strike cushion 19, transmitting the force of the blow by way of plate 27 to the pile 23 to drive that pile into the ground. The tube or sleeve 21 may include fins, such as 29 and 31, for heat dissipation purposes, and a venting arrangement as at 33 may be provided to allow the free escape of air or water from the interior of the sleeve 21 as the ram 17 descends therein.

FIG. 1 illustrates the roller cam 13 in its bottom dead-center position within housing 35. The housing also supports a hydraulic drive motor 37 of FIGS. 8, 9 and 10, having a drive shaft 39 connected to the center of a circular disc 11. Disc 11 is journaled to rotate with drive shaft 39 in response to operation of the hydraulic motor 37. Roller cam 13 is rotatably affixed to the circular disc off-center thereof by a distance about one-half the free fall distance of ram 17.

Ram 17 has a substantial mass which includes the mass of the cylindrical portion 43 of the ram as well as the mass of the bearing plate 15 and an additional weight 45. A plurality in the range of two to four guide rods, such as 47 and 49, are fixed to housing 35 and to the shoulder and ram guide member 51 while weight 45 has a like plurality of holes, so that as ram 17 executes its vertical reciprocatory motion, the ram cylinder 43 is guided by the opening in ram guide 51 at the bottom and the opening 53 of FIG. 8 in the lower portion of housing 35 at the top. Weight 45 is similarly guided as it slides along the several guide rods, such as 47 and 49.

FIGS. 1, 6, 8 and 9 illustrate the roller cam 13 in its bottom dead-center position. Just prior to this time, the counterclockwise rotation of disc 11 has caused roller cam 13 to pass beneath and engage the underside of bearing plate 15. Continued counterclockwise rotation of disc 11 causes roller cam 13 to migrate along the lower surface of bearing plate 15 and to raise the ram 17 as sequentially illustrated in FIGS. 2 and 3. FIG. 3 illustrates a top dead-center position for the cam member 13 and additional counterclockwise rotation of disc 11 results in the bearing plate 15 separating from the cam member 13, allowing ram 17 to free fall solely under the influence of gravity until the ram impacts the pile being driven. Of course, the continued rotation of disc 11 and corresponding movement of the roller cam in a circular counterclockwise path sequentially, repetitively causes the roller cam to engage the underside of the bearing plate, raise the ram and disengage the bearing plate, allowing the ram to fall and again impact the pile. During approximately half this cycle, the cam member 13, and therefore also disc 11, support the entire mass of ram 17, and to prevent the entirety of this load from being borne by the bearings of hydraulic motor 37, or other bearings associated with the drive shaft 39, an additional bearing support 55 of FIG. 8 is positioned beneath the circular disc 11 generally tangential thereto to at least partially support the weight of the ram while the ram is being raised.

Figure 5:
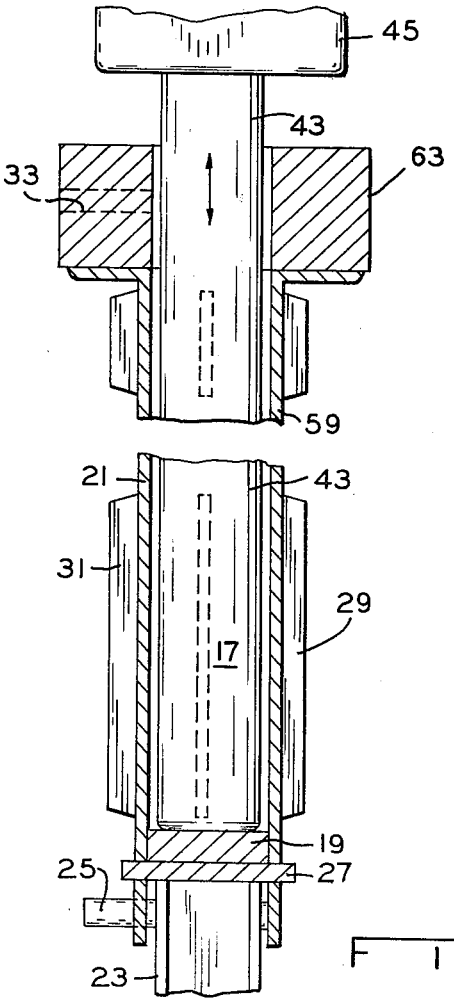
FIG. 5 is a side elevation view in cross-section of the lower portion of the drop hammer assembly illustrating a variation thereon.

The drop hammer assembly also includes a sleeve 57, 59 and 61 of FIGS. 1, 5 and 6 and 7 respectively which sleeve is removably attachable to a pile 23 at the upper end thereof and extends upwardly therefrom to provide a sleeve or tube within which a portion of the ram 17 may reciprocate. As illustrated in FIG. 5, this sleeve includes an escape path 33 for air moisture and the like with this escape path or vent comprising a fluid passing passageway extending from the opening in the base or ram guide 63 communicating with the lower interior of tube 59. The sleeve arrangement reduces the noise produced by the pile driving process by providing a cushion member 64 in FIG. 1 or 19 in FIG. 5 near the bottom of the sleeve and in good force transmitting relationship with the pile upper end so as to transmit driving force from the falling ram 17 to the pile 23 in a relatively quiet manner. Sleeve 59 may optionally be provided with a series of heat dissipating fins, such as 29 and 31, which extend outwardly from the sleeve to aid in transferring heat generated by friction between the ram cylindrical portion 43 and the sleeve 59 to the ambient atmosphere.

The drop hammer assembly is designed to be crane supportable and a pulley 65 and cable 67 of FIG. 8 serve to support the drop hammer assembly from the crane. With this cable arrangement the drop hammer assembly may be raised, moved and lowered to position it over a pile to be driven and the drop hammer assembly may be continually supported by the crane and periodically lowered to drive the pile or the drop hammer assembly may be fastened to the pile to be pile supported during the driving operation. A hydraulically actuable clamp arrangement 25 of FIG. 5 or 69 of FIG. 6 may be employed for removably attaching the sleeve to a pile. The hydraulic clamp arrangement, as well as the hydraulic drive motor 37, derive their power from a hydraulic source, such as the pump 71 of FIG. 10, which pump is driven by the crane prime mover.

Figure 7:
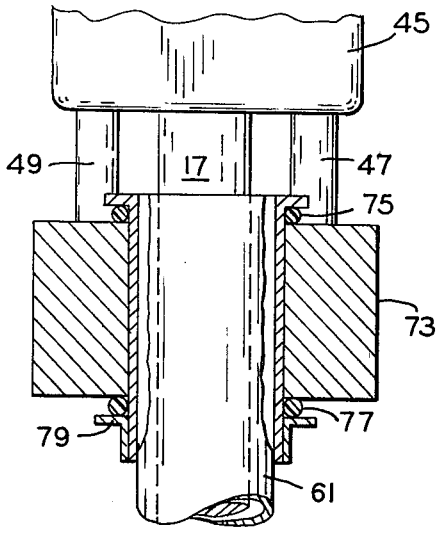
FIG. 7 is a detailed view in section of the shock mounting feature of FIG. 6.
Figure 6:
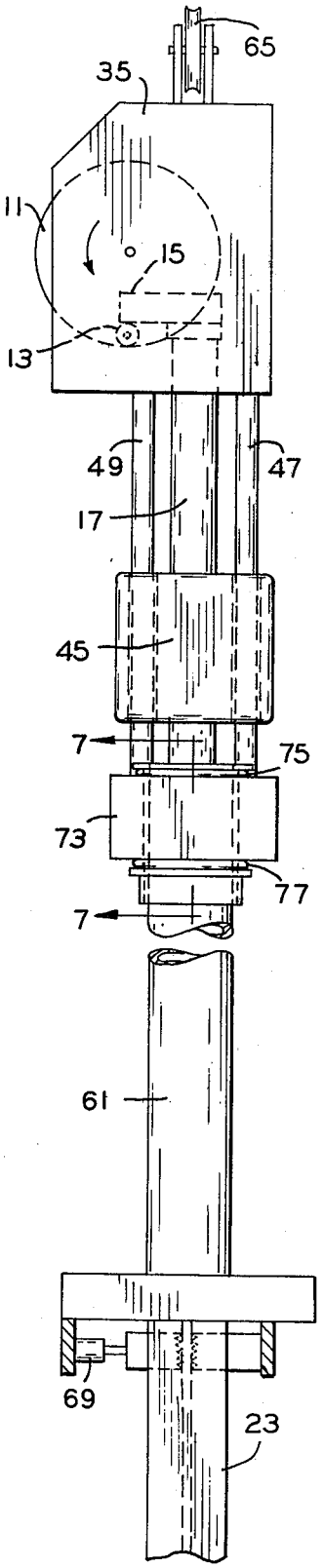
FIG. 6 is a side elevation view similar to FIG. 1 but illustrating a further variation thereon.

FIGS. 6 and 7 illustrate a further variation on the sleeve arrangement of FIG. 1 and the modified sleeve arrangement of FIG. 5. In FIGS. 6 and 7, a cushioning arrangement between the base or ram guide 73 and sleeve 61 is illustrated employing a pair of O-rings 75 and 77 between base 73 and a bushing 79, forming an integral part of the sleeve 61. These O-rings 75 and 77 function to minimize the transmission of vibration between sleeve 61 and the pile to which it is clamped, on the one hand, and the housing 35 and ram 17, including weight 45, on the other hand.

Figure 10:
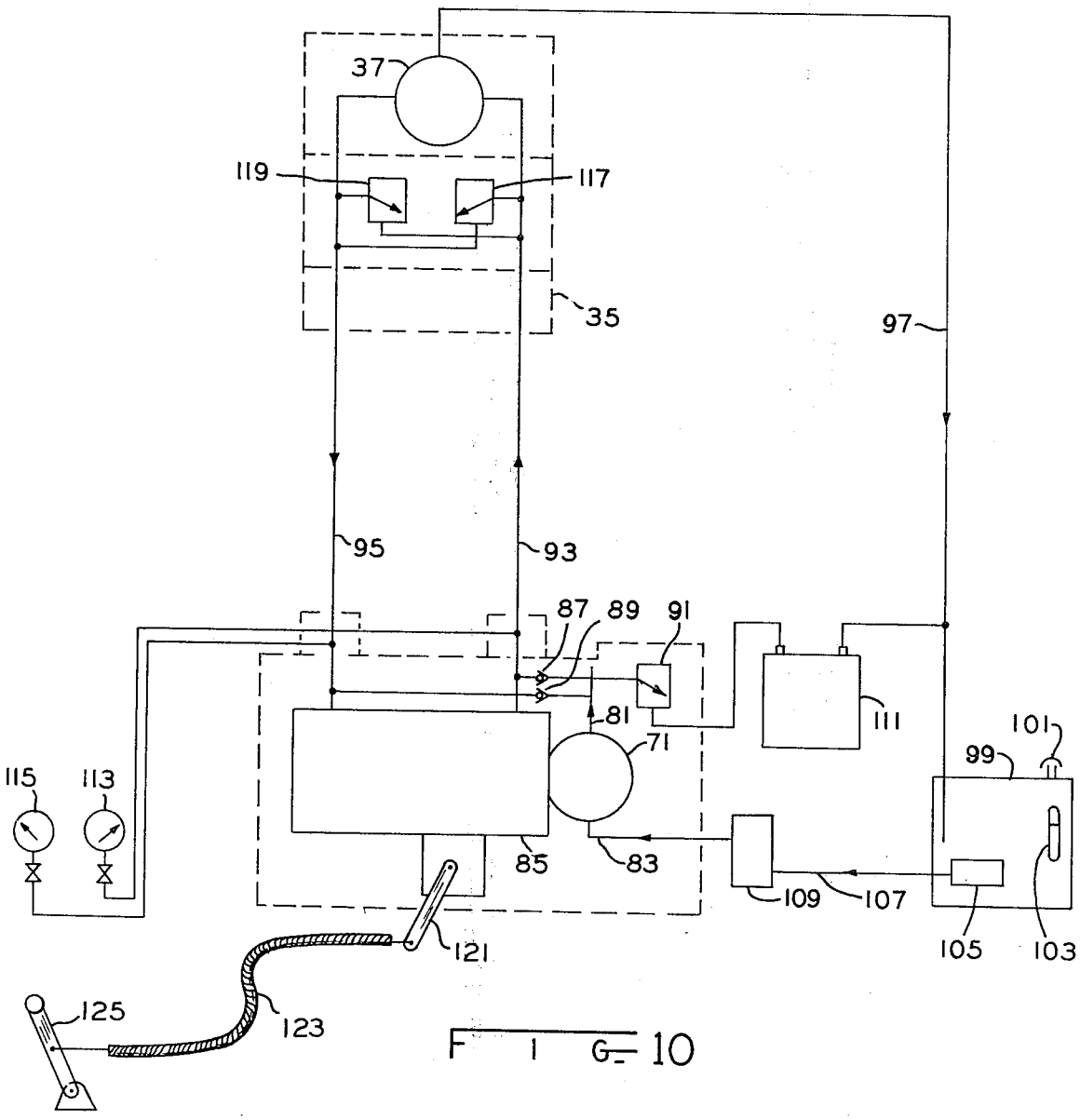
FIG. 10 is a schematic illustration of one hydraulic system according to the present invention.

Many relatively conventional hydraulic systems may be employed for driving the hydraulic motor 37 with one such system illustrated schematically in FIG. 10. In FIG. 10, pump 71 is driven by the crane prime mover and has a high pressure output line 81 and an inlet line 83, as well as having an inlet from the control valve arrangement 85. The high pressure line is connected to a pair of check valves 87 and 89, as well as a high pressure relief valve 91 with the check valves 87 and 89 being connected respectively to high pressure lines 93 and 95, leading to housing 35 and the hydraulic motor 37. A drain line 97 from the motor 37 returns hydraulic fluid to a reservoir 99, which as depicted, has a fill cap 101, a liquid level gauge 103, and a strainer 105, connecting the reservoir outlet by way of line 107 to a further filter 109 and to the pump inlet line 83. Relief valve 91 also provides a path by way of heat exchanger 111 back to the inlet of reservoir 99. Pressure in the two high pressure lines 93 and 95 may be monitored by pressure gauges 113 and 115, respectively, and additional relief valves 117 and 119 for bypassing hydraulic fluid around the motor 37 in the event that that pressure becomes too great may also be provided. Control valving arrangement 85 has an operating rod 121 connected by way of a Bowden wire 123 to an operator control handle 125.

Control arrangement 85 functions as a pressure vessel so that when the operating rod 121 is in one position, fluid flows upwardly as viewed through line 93 to drive hydraulic motor 37 with the return path for the fluid being by way of line 95. Another position of operating rod 121 changes the valving arrangement within control arrangement 85 so as to block fluid flow to the hydraulic motor 37 and optionally a further operating rod position may again change the valving arrangement so as to reverse the direction of rotation of the hydraulic motor, for example to lower the ram slowly, if so desired.

From the foregoing, it is now apparent that a novel drop hammer arrangement has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. For use in a pile driving process, a crane supportable hydraulically actuable drop hammer assembly comprising:

a housing supporting a hydraulic drive motor having an axially extending drive shaft and a roller cam offset from the motor drive shaft axis of rotation by a distance limiting the drop hammer free fall distance;

means coupling the roller cam to the drive shaft of the motor to execute circular motion about the axis when the drive motor is operated comprising a circular disk centrally affixed to the motor drive shaft for rotation therewith with the roller cam rotatably affixed to the circular disk off center thereof;

a ram having a substantial mass and having a bearing plate selectively engagable with the roller cam;

bearing support means positioned beneath the circular disk generally tangential thereto to at least partially support the weight of the ram while the ram is being raised;

guide means for limiting ram motion to generally vertical reciprocating motion normally limited at one extreme by a pile being driven and at the other extreme by the uppermost position of the roller cam;

movement of the roller cam in a selected direction along its circular path sequentially repetitively causing the roller cam to engage the underside of the bearing plate, raise the ram, and disengage the bearing plate allowing the ram to fall and impact a pile.

2. The drop hammer assembly of claim 1 further comprising means for cushioning impact between the ram and pile to reduce the noise produced by the pile driving process.

3. The drop hammer assembly of claim 2 wherein the means for cushioning impact comprises a sleeve removably attachable to a pile upper end and extending upwardly therefrom within which a portion of the ram may reciprocate, and a cushion member near the bottom of the sleeve and in good force transmitting relationship with the pile upper end to transmit driving force from the falling ram to the pile in a relatively quiet manner.

4. The drop hammer assembly of claim 3 further including heat dissipating fins extending outwardly from the sleeve to aid in transferring heat generated by friction between the ram and the sleeve to the ambient atmosphere.

5. The drop hammber assembly of claim 3 wherein the sleeve includes a hydraulically actuable clamp arrangement for removably attaching the sleeve to a pile.

6. The drop hammer assembly of claim 1 further comprising means for coupling the hydraulic drive motor to a crane prime mover driven hydraulic source.

7. For use in a pile driving process, a drop hammer assembly comprising:

a housing including a drive motor, and a cam member for executing generally circular motion within the housing in response to operation of the drive motor, the cam member comprising a circular disk journalled for rotation about the center of the circle and a roller cam affixed to the disk at a distance removed from the circle center which is about half the ram free fall distance;

a ram having a substantial mass and having a bearing plate selectively engagable by the cam member with can motion sequentially raising the ram and disengaging the bearing plate allowing the ram to free fall and impact a pile;

bearing support means positioned beneath the circular disk generally tangential thereto to at least partially support the weight of the ram while the ram is being raised;

guide means for limiting ram motion to generally vertical reciprocating motion normally limited at one extreme by a pile being driven and at the other extreme by the uppermost position of the cam member; and means for cushioning impact between the ram and pile to reduce the noise produced by the pile driving process including a sleeve removably attachable to a pile upper end and extending upwardly therefrom within which a portion of the ram may reciprocate, and a cushion member near the bottom of the sleeve and in good force transmitting relationship with the pile upper end to transmit driving force from the falling ram to the pile in a relatively quite manner.

8. The drop hammer assembly of claim 7 further including heat dissipating fins extending outwardly from the sleeve to aid in transferring heat generated by friction between the ram and the sleeve to the ambient atmosphere.

9. The drop hammer assembly of claim 7 wherein the sleeve includes a hydraulically actuable clamp arrangement for removably attaching the sleeve to a pile.

10. The drop hammer assembly of claim 7 wherein the ram bearing plate comprises a relatively flat downwardly facing surface along which the roller cam may roll during the raising of the ram.

11. The drop hammer assembly of claim 7 wherein the sleeve includes means for providing an escape path for air, moisture and the like which may be within the tube and displaced by the free falling ram.

* * * * *